US006041722A

United States Patent [19]

Baker

[11] Patent Number: 6,041,722

[45] Date of Patent: Mar. 28, 2000

[54] EVENT TABLES

[76] Inventor: Gary Baker, 1100 Skyline, North Little Rock, Ark. 72116

[21] Appl. No.: 09/168,284

[22] Filed: Oct. 8, 1998

[51] Int. Cl.[7] ..... A47B 1/04

[52] U.S. Cl. ..... 108/77; 108/64; 108/69

[58] Field of Search ..... 108/77, 69, 66, 108/64, 65, 116, 117, 132

[56] References Cited

U.S. PATENT DOCUMENTS

| | | | |
|---|---|---|---|
| 2,010,855 | 8/1935 | Fuller | 108/69 X |
| 2,536,511 | 1/1951 | Megies | 108/69 X |
| 2,585,111 | 2/1952 | Grauer | 108/64 X |
| 2,695,827 | 11/1954 | De Saussure, Jr. | 108/132 X |
| 2,836,475 | 5/1958 | Sapp | 108/64 |
| 3,342,147 | 9/1967 | Shettles | 108/64 |
| 4,597,553 | 7/1986 | Rorabaiugh | 108/117 X |
| 4,646,654 | 3/1987 | Sullivan | 108/69 |
| 4,949,649 | 8/1990 | Terres et al. | 108/116 |
| 4,991,325 | 2/1991 | Teduschi | 108/116 X |

*Primary Examiner*—Jose V. Chen
*Attorney, Agent, or Firm*—Dennis B. Haase

[57] ABSTRACT

The present disclosure relates to a multi faceted event table having the capability of achieving a variety of different and highly useful configurations, either in combination with one or more like tables, or standing alone, to thereby provide a single table usable in a wide variety of events, while at the same time being light weight and easily handled both in set up and break down with greatly reduced storage space compactness.

29 Claims, 8 Drawing Sheets

EVENT TABLES

The present invention relates, in a general sense, to tables and, with more particularity, to tables capable of assuming, conjointly with other similarly constructed tables, various configurations suitable for the accommodation of a number of persons participating in an event, such as, for example, a banquet, convention, seminar, wedding, lecture and so on.

BACKGROUND OF THE INVENTION

1. Field of the Invention

The staging of events is big business. Whether an event is to be held in a hotel, office, coliseum, theater, or a big open space, the conduct of such events has become an industry unto itself. Since man graduated from sitting around the camp fire to the conference room, the table has been the mainstay of every conceivable event where folks congregate for a common purpose.

Today there are banquets, seminars, theater, including dinner theater, expositions, parties, casino gambling, and the list is endless.

Interestingly, in every event that centers around tables, the tables are configured differently depending on what type of event is contemplated.

Yet the industry response is to provide two, and perhaps three basic tables, e.g., rectangles, which include square tables, and rounds. Some tables have leaves that can be inserted to change the size of the table, and others have leaves that fold into position level with the table top and retract out of the way when not needed. Yet, the basic configuration remains the same, i.e., round or rectangular.

Additionally, the tables that are commercially available today are typically heavy, difficult to handle, from storage to set up, to breakdown and moving from location to location. Such tables typically require at least two people to manipulate them, and often necessitate a cart to transport them. Thus, set up and breakdown costs are high, and storage is an additional problem.

2. Overview of the Prior Art

As will be quickly apparent, there are several facets of the event table of the present invention which are inextricably intertwined to make a unique and particularly useful unit. The prior art is singularly lacking in any reference which, in and of itself, defines the present invention. There are, however, pretenders which illustrate the state of the art relative to table shapes which are the current standard in the industry.

By way of example, Sullivan U.S. Pat. No. 4,646,654 depicts a standard "square" which, fortuitously, provides drop leaves that convert the shape to a "round ". To a similar effect is Tordsen U.S. Pat. No. 5,513,578 and Sullivan U.S. Pat. No. 2,907,616.

Pollak U.S. Pat. No. 4,815,393 is somewhat more imaginative in that it departs somewhat from the rectangle/round standard to provide an extendable plate from a round as seen in FIG. 1. FIGS. 5 and 6, as discussed in column 3, however, revert to the square/round standard.

Finally, Carlson, in his U.S. Pat. No. 2,273,006 offers some deviation from the norm by providing a square table with leaves which, when selectively extended, form a polygon.

It will be immediately apparent to even the most casual observer, that none of the foregoing efforts define available space in the exclusive style and manner of the present invention.

It is a feature of the table of the present invention that the leaves fold from their extended position to a position under the main portion of the table in such a manner that the terminus, or end, of the table presents a flat perpendicular edge. Several features meld together to create such a surface, which is essential to the ability of the table to be connected with like tables to form various useful patterns.

SUMMARY OF THE INVENTION

The present invention comprises a multi faceted event table which, standing alone or in concert with a multiplicity of like tables, provides an event manager with heretofore unknown versatility and unprecedented flexibility in organizing an almost entire gamut of events, ranging from the most rudimentary dinner party or lecture, to vastly more complicated, and creative, theater parties, wedding receptions and even expositions.

The foregoing is accomplished with a single, leaved table configuration, which, by virtue of its unique design, is capable singularly, and by conjoining other similarly structured tables together, of providing a number of seating patterns that is limited only by one's imagination.

In addition to the foregoing, it is one objective of the present invention to provide an event manager with a structurally sound multi faceted table that will be sufficiently flexible in use so as to permit the purchase of only one style table, i.e., for all of his or her event needs.

Another objective is to provide an event table that is readily and positively interconnected to other such tables to provide a structurally sound table train having a variety of possible patterns, which is limited only by the event manager's imagination.

A further objective of the present invention is to provide a table that will permit an event manager the flexibility to seat as few as two, and as many as the event venue will hold, by using one table, or a train of such tables interconnected in any one of a large variety of patterns that make it possible, when necessary, for all participants to see, and/or participate in, the event without turning chairs around, or peering over, through or around a neighbor.

Ancillary to the previous objective is the providing of an event table as described wherein an optimum number of people may be comfortably accommodated, with sufficient elbow room to avoid impairing one's neighbors' enjoyment of the event, and sufficient leg room without banging one's knees on table legs or other supports.

It is a purely economic objective of the present invention to provide a table with all of the attributes accorded to it herein, which table is both light weight and collapsible in such a fashion as to make handling, moving and storage a simple task and if necessary, could be accomplished by a single person, thus providing a dramatic reduction in labor related costs of set up and breakdown.

It is an objective, corollary to the foregoing, to provide a table of such construction that labor costs attendant its use are readily controlled and greatly reduced relative to existing and available tables.

A still further objective is to provide an event table that permits a positive connection with like tables, resulting in a train of tables which is solid in fact, as well as to the feel, thereby providing confidence in the event manager, and the participant alike that the train will not come apart, or individual tables will move inadvertently causing spills, breakage, or worse. In particular, one seated at the table will feel that he or she is free to move into or away from the table without embarrassment to ones self or damage to the setting.

It is also an objective of the present invention to provide a table of the type and character described that is height adjustable to permit a myriad of display and lecture uses with complete comfort to participants.

The foregoing, as well as several other and additional objects and advantages will become apparent from a reading of the detailed description of a preferred embodiment of the present invention, taken in conjunction with the accompanying drawings, wherein:

IN THE DRAWINGS

DETAILED DESCRIPTION OF A PREFERRED EMBODIMENT

Figure 1:
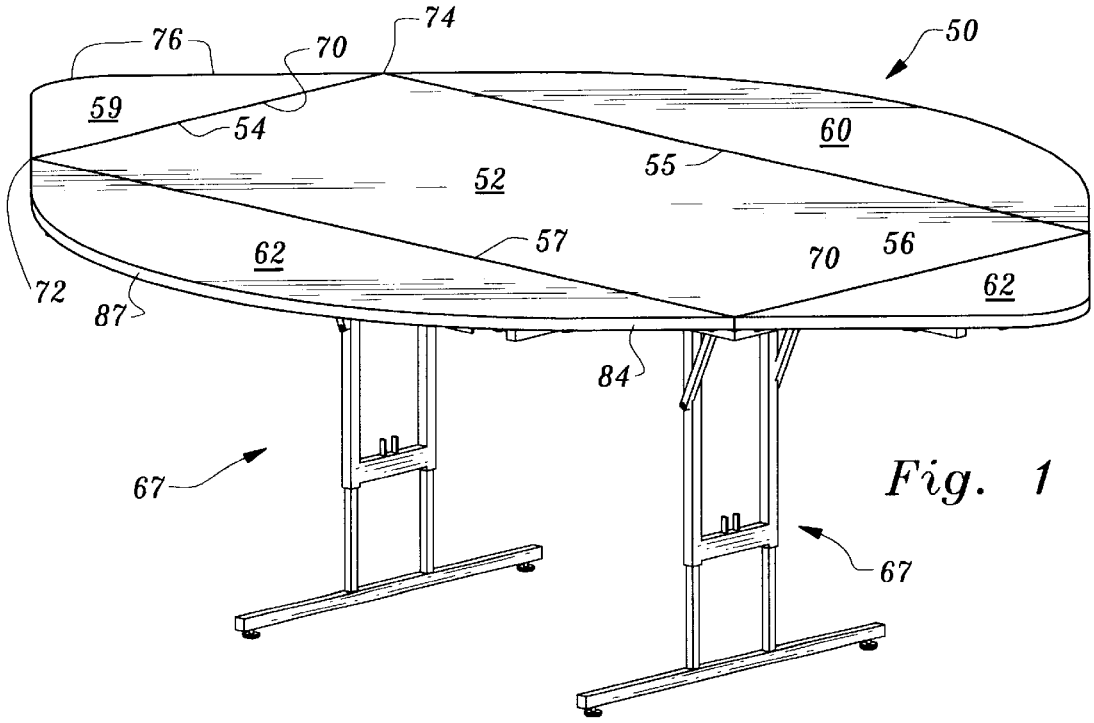
FIG. 1 is a pictorial representation of an event table constructed in accordance with the present invention, and illustrating the overall shape of the table with all leaves fully extended.
Figure 2:
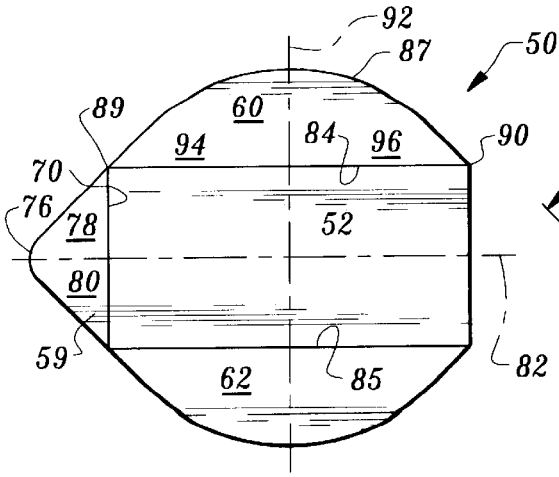
FIG. 2 is a top plan view of the table of FIG. 1, illustrating the configuration with an end leaf retracted.
Figure 3:
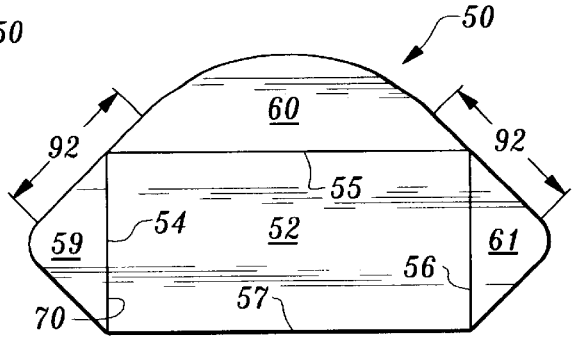
FIG. 3 is a top plan view of the table of FIG. 1, illustrating the configuration with a side leaf retracted.

With reference now to the drawings, and initially to FIG. 1, there is shown an event table 50 which has been constructed in accordance with the present invention. For purposes of this discussion, an event table is a table which is particularly suited for use in a commercial setting, as distinguished from the familiar dining room or kitchen table, and is necessarily strong enough and versatile enough to be set up for use and broken down for storage before and after any one of a number of events, including, but not limited to, seminars, exhibitions, banquets, and an infinite number of social gatherings from wedding receptions to dinner/entertainment events.

The event table 50 comprises a rectangular table top 52, having adjoining straight sides or edges 54, 55, 56 and 57, opposed pairs of which are of equal length. For example, edges 54 and 56 are of equal length as are edges 55 and 57.

Figure 10:
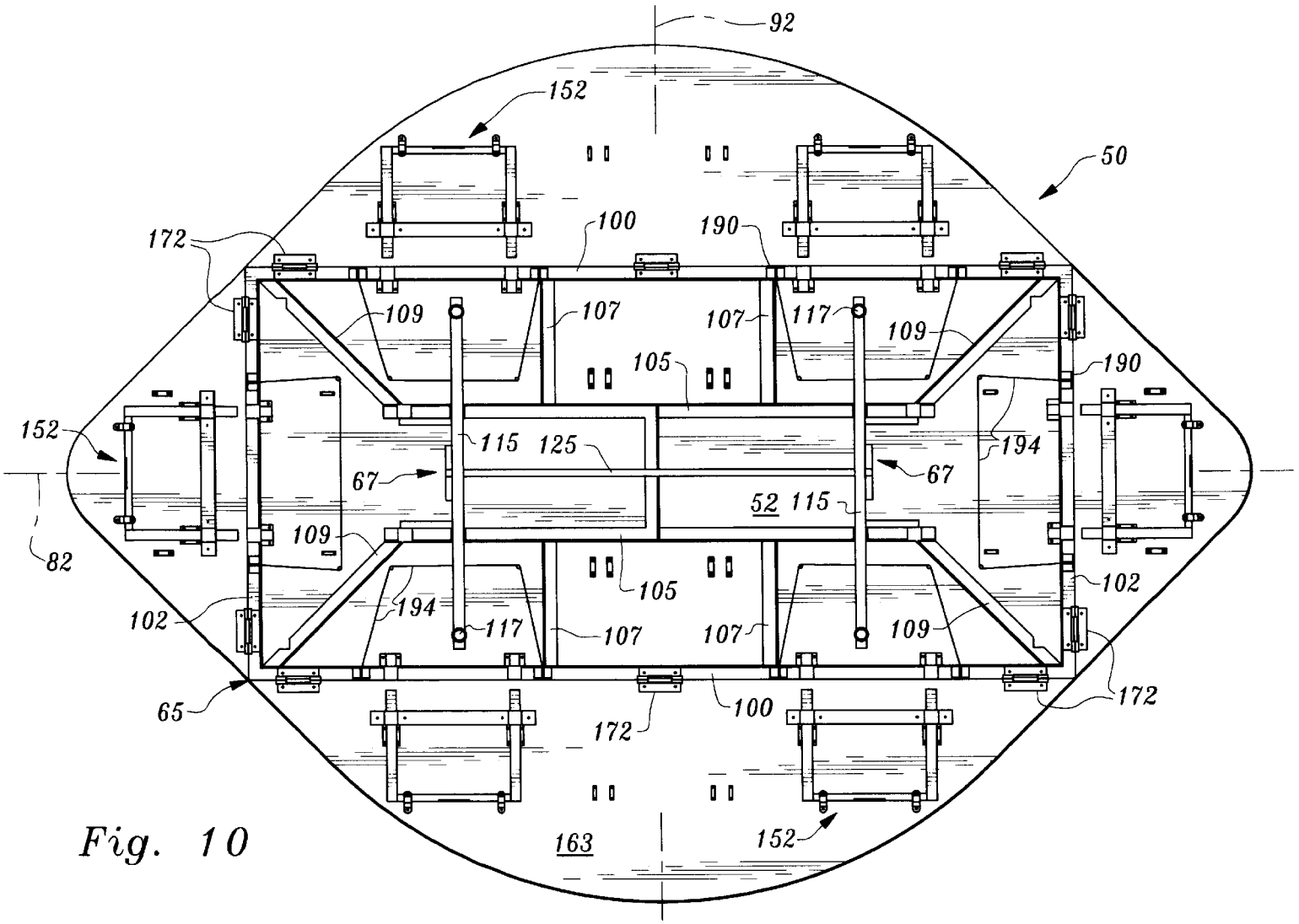
FIG. 10 is a plan view of the underside of a table constructed in accordance with the present invention, with all leaves fully extended, and illustrating the various support and locking components in their relative location and, with the exception of the leaf supports, in their retracted position.
Figure 11:
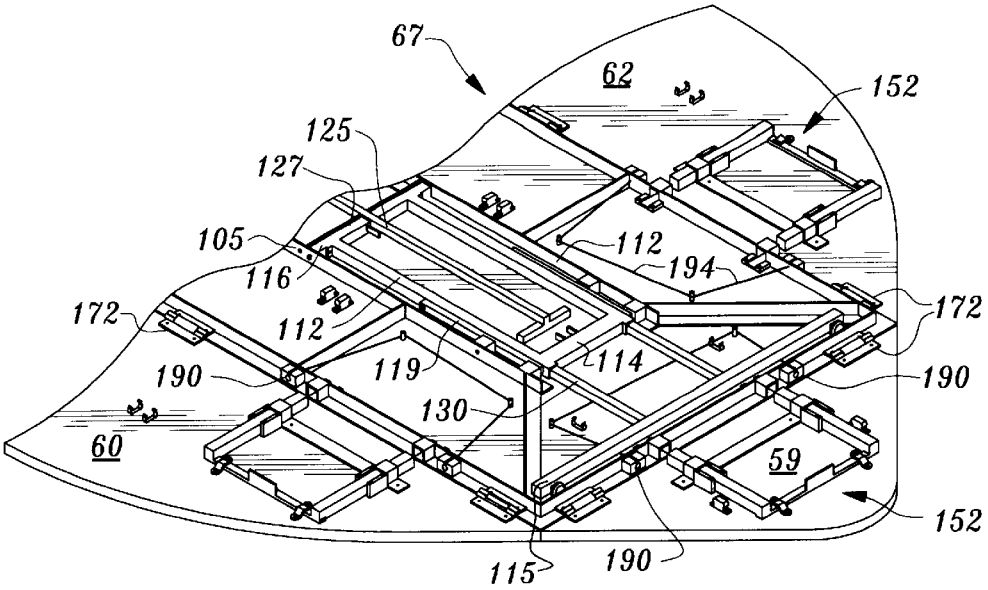
FIG. 11 is a fragmented section of the table undersurface as viewed in FIG. 10, which focuses on the table support mechanism and the leaf support mechanism.

The table 50 is equipped with extendable leaves 59, 60, 61 and 62 one of which is hingeably secured to an edge of the table top 52. The table top 52 is mounted to a frame 65, best seen in FIG. 10. The frame, in keeping with the objective of providing optimum strength while adding a minimum of weight to the event table, is constructed of tubular metal, although clearly there are many high tech materials which, if cost effective, would suffice without departure from the invention.

The event table 50 is stabilized for use on retractable supports 67, of which two have been found not only to be entirely adequate, but advantageous in use by minimizing incidences of bumped shins or stubbed toes.

Having thus provided an overview of the event table in terms of its structural elements, emphasis is now placed on the versatility of the event table by reference to the drawings and, in particular, FIGS. 1 through 9, where the manifold capabilities of a single table will become apparent.

In appreciating the functionality of the event table, consideration need be given to the unique configuration of the various leaves 59, 60, 61 and 62. It will be observed that opposed leaves, such as for example, leaves 59 and 61 are of substantially identical profile. It will also be observed that adjacent leaves, for example leaves 59 and 60 are of markedly different profiles.

With reference to leaves 59 and 61, it will be noted that each has a straight edge 70. Beginning at the termini 72 and 74, respectively, of the edge 70, a curved edge 76 is generated which provides for symmetrical, but opposite segments 78 and 80 on either side of a longitudinal axis or centerline 82—82, shown in FIG. 2, of the table 50. It will be appreciated that the overall shape of the curved edge 76 of leaves 59 and 61 is non circular, i.e., it is not generated by a single radius, and is, therefore, more closely related to parabolic than round, which, as will become clear, is a valuable enhancement to the multifaceted capability of the table.

It will be further appreciated that the remaining opposed leaves 60 and 62 are fashioned with the same objectives in mind. Thus, each of leaves 60 and 62 has a straight edge 84. A curved edge 87 is generated on a soft curve from the termini of the straight edge 84. As in the case of the leaves 59 and 61, the curvature is non circular, and reaches its apex at the intersection of the curved edge 87 and the latitudinal axis or centerline 92—92 of the table 50, resulting in two equal but opposite segments 94 and 96.

As is the case with respect to leaves 59 and 61, the curve is not circular, but tends to be more parabolic in its appearance. It will be seen in FIGS. 2, 3 and 9, the curved edges 76 and 87 are flattened out as they approach the termini of their respective straight edges and are so aligned that an essentially straight edge segment 92 (FIG. 3 ) is created in the area of the termini of the straight edges 70 and 84 of adjacent leaves when any two of those adjacent leaves are in the up and extended position.

In arriving at the unique shape of the table of the present invention, a circle was generated, and then expanded diametrically at the north and south diametrical line, while contracting the east and west, or more particularly, perpendicular or the transverse diametral lines. For a six foot diameter circle, the north/south diametral lines was extended by one foot. While the east/west diametral line was compressed by one foot.

In addition, this distorted circle, the overall general appearance of which is as viewed from the top, is generally elliptical, was further modified, as needed to a rectangular table top to fit within said ellipse such that the four corners of the table top touch perimeter of the circle.

It will now be appreciated that by virtue of the unique leaf configuration just described, the table 50, standing alone, is capable of being configured into no less than nine distinct and useful shapes which may seat as many as ten comfortably (FIG. 1) for a banquet. Banquet tables require that a large number of people be accommodated in a relatively small space, and the table of the present invention does precisely that. It also configures for a meeting (FIG. 2) with a special place for the speaker at the head of the table. A meeting table needs to seat eight to ten participants in a reasonable space, and this table accomplishes that feature in a ten square foot space.

If the event is a casino night, for example, a casino table (FIG. 3) is readily provided, which provides space for a select few, focused on a dealer, for example, providing about two feet of perimeter space per person in this crown or game configuration.

Figure 4:
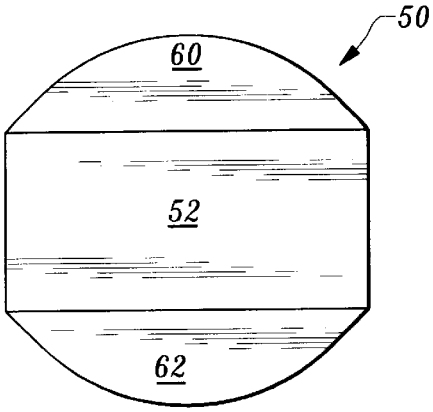
FIG. 4 is a top plan view of the table of FIG. 1, illustrating the configuration with both end leaves retracted.
Figure 5:
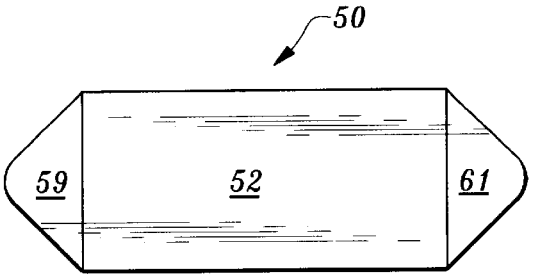
FIG. 5 is a top plan view of the table of FIG. 1, illustrating the configuration with both side leaves retracted.
Figure 6:
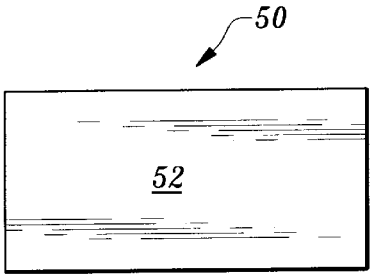
FIG. 6 is a top plan view of the table of FIG. 1, illustrating the aconfiguration with all leaves retracted.

When the event is a reception, the table needs to be able to seat a moderate number of folks in a classic shape, such as seen in FIG. 4. If the event is a picnic, the concept is to seat, comfortably, an optimum number of people in a minimum space, and in a configuration which affords maximum social interaction, and this is accomplished as seen in FIG. 5. In a seminar or lecture mode, however, the object is to seat participants comfortably, but efficiently, facing a stage or podium, and the configuration of FIG. 6 does an excellent job.

Figure 7:
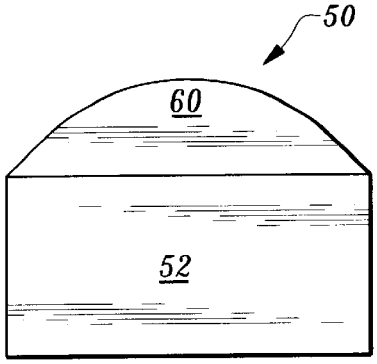
FIG. 7 is a top plan view of the table of FIG. 1, illustrating the configuration with a single side leaf extended.

This same, highly versatile table can also provide minimal seating with excellent space for display purposes, thus filling the need for an exposition or display table as seen in FIG. 7.

Figure 8:
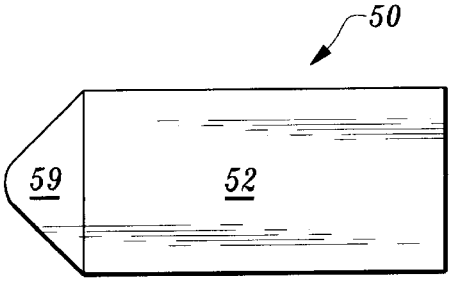
FIG. 8 is a top plan view of the table of FIG. 1, illustrating the configuration with a single end leaf extended.
Figure 9:
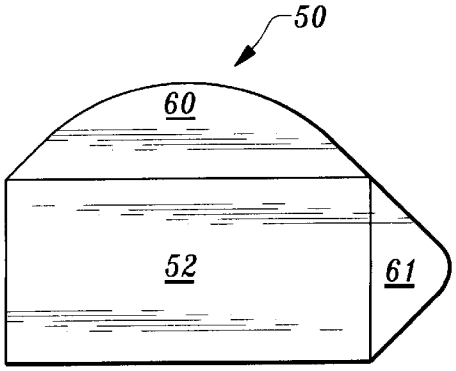
FIG. 9 is a top plan view of the table of FIG. 1, illustrating the configuration with one end leaf and one side leaf extended.

Perhaps the event is simply a party, and that means being able to seat a relatively small number of people in a configuration which permits good interaction among those seated, and, once again, this is accomplished by this single table, configured as seen in FIG. 8. Perhaps the party is a theater party, which means that those seated want to be able to interact, but still have an unrestricted view of a stage, or some performing area, and the configuration of FIG. 9 permits everyone at the table to have a ringside seat with an unobstructed view of the area where performers are entertaining the group.

In order to achieve a previously unattainable versatility which is a principal objective of the event table of the present invention, it is first necessary to a number of structural nuances, which make such achievement possible. At the very foundation of the table 50 is the strong, yet light weight frame 65. The frame, referring to FIG. 10, comprises a tubular lattice comprised of parallel frame rails 100, tied at their ends by cross members 102 to form a rectangular box. Inner rails 105 are tied into the frame rails 100 by means of struts 107 and angularly disposed braces 109, which inhibit torquing or twisting of the table if hit with a glancing blow which has a substantial horizontal force component. It will be appreciated that the frame may be constructed of any of several well known materials, and by a variety of well known methods, all without departure from the essential features of the invention.

The resultant framework 65 is secured to the tabletop 52, in any well known manner, which adds additional rigidity to the frame, and, thus, is both strong in all directions, yet suitably light weight.

It is an important feature of the present invention that when it is collapsed for storage it is essentially self contained and exceptionally thin in girth, so that it, and others like it, may be easily nested for storage in minimal space and without danger to the handler from projections and sharp corners. To this end, the table supports 67 are designed to collapse into the framework 65 for storage, and extendable into their support position with a minimum interference with the leg and foot room available to those seated.

In order to achieve this particular objective of the invention, and with reference to FIGS. 10 through 13, supports 67 comprise a pair of tubular legs 112, joined at their upper ends by a transverse brace 114, and terminating in a foot 115 which is parallel both to the table top, and to the surface upon which it is intended to repose. Any one of several non skid devices, such as rubber buttons 117, may be fitted to the bottom of each foot.

The brace 114 extends beyond the tubular legs, which extension defines tabs 116. The tabs 116 engage, and are slidably secured in the track defined in the inner rails 105.

By virtue of this arrangement, the supports 67 may be collapsed outwardly, as distinguished from being folded inwardly toward one another, which represents the more contemporary thinking. It will be appreciated, however, that the same mechanism may be reversed to cause the supports to be collapsed inwardly without departure from the essential features of the invention.

Figure 12:
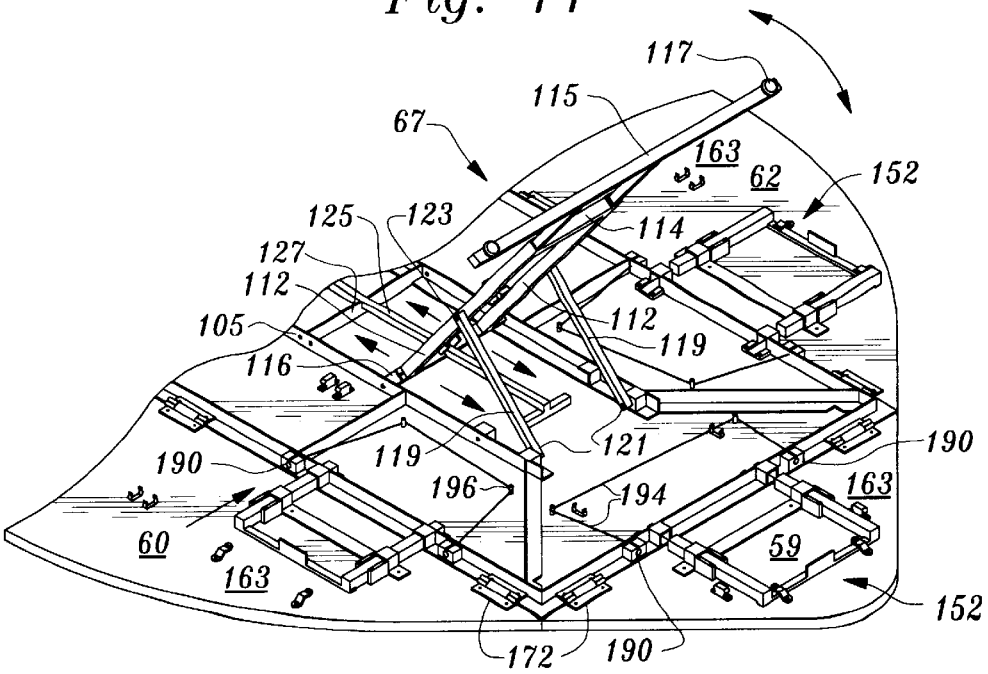
FIG. 12 is a fragmented view of the table undersurface as seen in FIG. 11, but with the table support partially extended.
Figure 13:
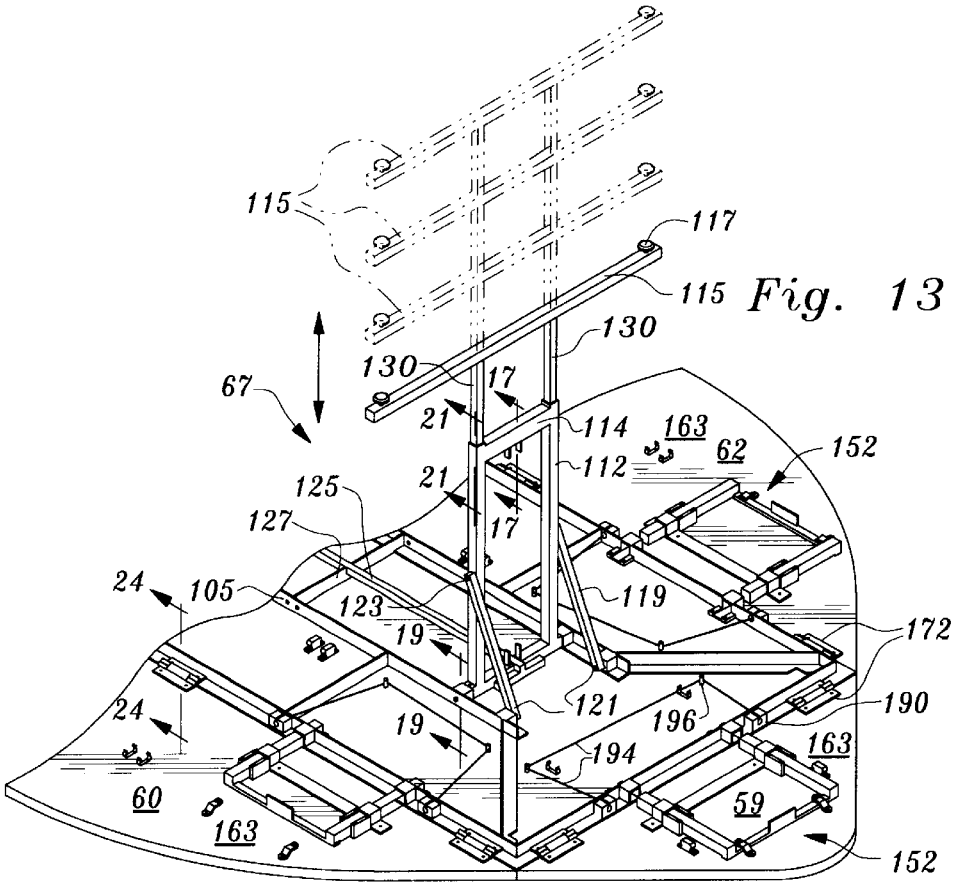
FIG. 13 is a fragmented view similar to that of FIG. 12, but illustrating a table support fully extended and locked and, further, showing the various lengths which the table support is capable of achieving.

While the capacity to collapse the supports outwardly is, seemingly, perhaps, of lesser significance, it will be appreciated, particularly when viewing FIGS. 12 and 13, this feature permits the supports 67 to be mounted further inwardly from the edge of the table, and toward the center thereof. As a result, the supports provide good overall stability for the table, and, additionally, they tend to be out of the sphere of interference with the knees and feet of those seated.

Figure 16:
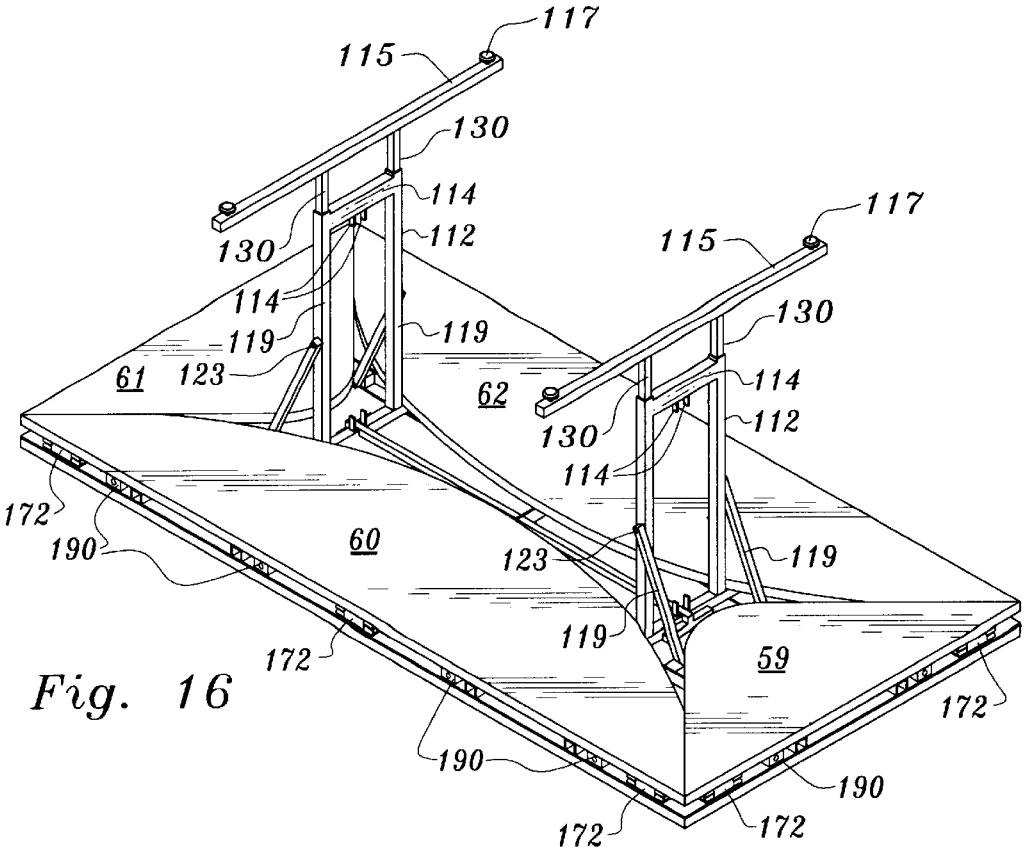
FIG. 16 is a pictorial view of the underside of the table, such as may be seen in FIG. 10, but illustrating in detail how the leaves retract and secure in a flat configuration without interference with the operation of the table supports.
Figure 17:
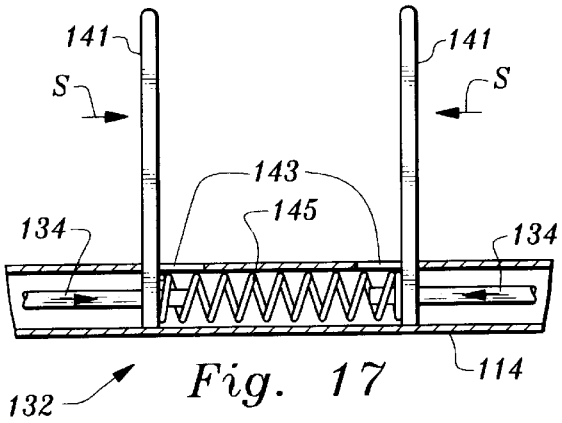
FIGS. 17 and 18 are substantially identical partial sectional views of a portion of the table support mechanism, illustrating a mechanism for manually adjusting the length of the table support.

Referring specifically to FIG. 16, the innate neatness and compact nature of the table, even with leaves folded, will be apparent. Moreover, the comfort of those seated is greatly enhanced at no sacrifice to structural integrity.

In order to provide proper positioning and additional strength for the supports, links 119 are provided and pivotally mounted to the frame, at 121, and to each of the tubular legs 112 at 123, thus firmly positioning the supports relative to the frame, while permitting free, yet controlled, movement between their extended and storage positions. In order to permit additional guidance for the supports 67, while assuring no lateral deviation from the predetermined path of the supports, a centrally disposed axial guide 125 is provided, which intersects and slidably engages a transverse base member 127. As the support 67 moves between its extended and collapsed position, the base member slides on and is guided to and from its extended position along the axial guide 125, thereby insuring smooth transition of each support 67.

It is well recognized in the industry that the height of a table changes with its usage. For example, the height of a table to be used for writing or typing is different than the height of a table for dining. Moreover, if the table is to serve as a podium for a speaker, its height will be significantly different than other uses. To this end, and with particular reference to FIG. 13, the height of the table of the present invention is as variable as the table is versatile. To this end, inner legs telescope within the tubular legs 112, in an axial direction to adjust the height of the table to any one of several desirable heights to fit the then current usage.

Figure 23:
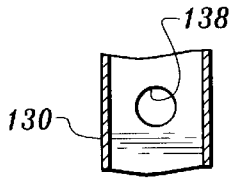
FIGS. 21, 22 and 23 are enlarged partial sectional views of the telescoping elements of the table support, illustrating one of a series of aligned apertures for selective receipt of the support locking mechanism.
Figure 18:
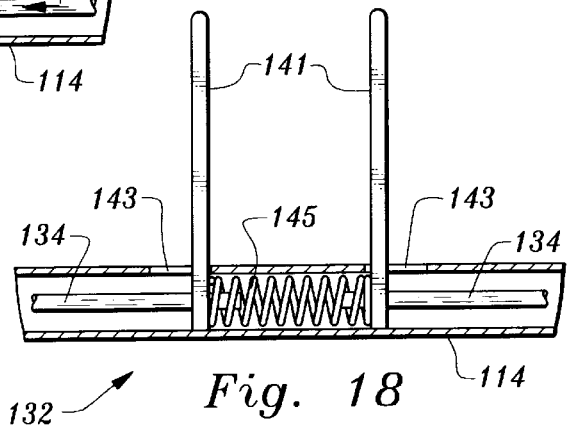
Figure 19:
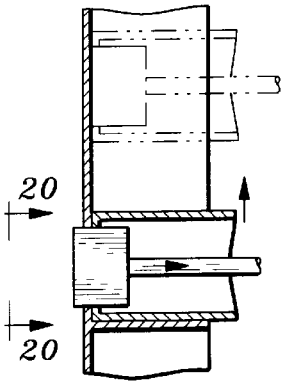
FIG. 19 is a partial sectional view of the perimeter lock system which permits a plurality of tables to be joined in a wide variety of useful configurations and patterns without sacrifice to stability and structural integrity.
Figure 21:
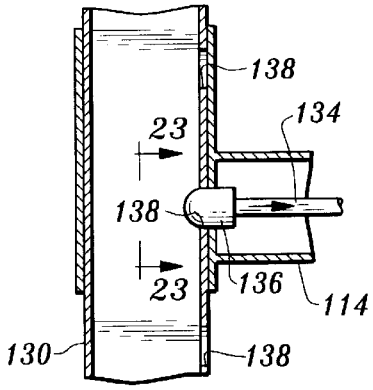
Figure 20:
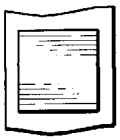
FIG. 20 is a partial view of FIG. 19 as seen from the position of line 20—20 thereof.
Figure 22:
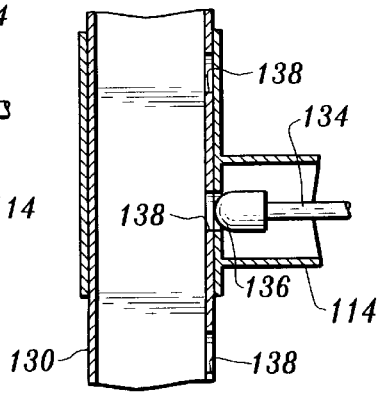

In order to assure the event manager that the height of a table, once set, will not inadvertently change, a detent mechanism 132 is employed, and it is illustrated in some detail, in FIGS. 17, 18 and 21 through 23. Referring first to FIGS. 21 and 22, a locking pin 134, of which there are two in the detent mechanism, which are coaxially and opposed, are provided within the tubular confines of the transverse brace 114. Each of the pins 134 has a rounded head 136, which is selectively nested in orifices 138, an example of which is seen in FIG. 23, formed in the legs 112 and the inner legs 130, respectively, when two such orifices are aligned by the telescoping movement of the inner legs 130. In this manner the supports are extensible between a podium height, for example, and a much lower, computer keyboard height, again by way of example.

The pins 134 move within the framework of the transverse movement by means of pinchers 141, which ride in and are guided by an axial opening, in the form of a slot, 143. The pins 134 are normally biased outwardly by a spring 145, but by applying squeezing pressure in the direction of the arrows S in FIG. 17, the pins are moved inwardly toward the center of the detent mechanism so as to permit movement of the legs 130 to effect alignment of a different set of holes or orifices 138. Once that alignment is achieved, squeezing pressure is released and the pins pass through the orifices so aligned to fix the relative position of the legs 112 and 130, thereby establishing the desired height of the table for the then current use.

The rounded heads provide smooth engagement of the pins in the orifices and facilitate their release to effect change in the height of the table.

In keeping with the objective of eliminating as much interference with the comfort of those seated, and further to maintain the thinness of the table in its collapsed, storage mode, it becomes important to permit support of the leaves of the table, while eliminating the over center hinge mechanism that is in common use in the industry today. To this end, a simple, yet effective, slide bar mechanism 150 has been devised and is illustrated in some considerable detail, in FIG. 14.

Figure 14:
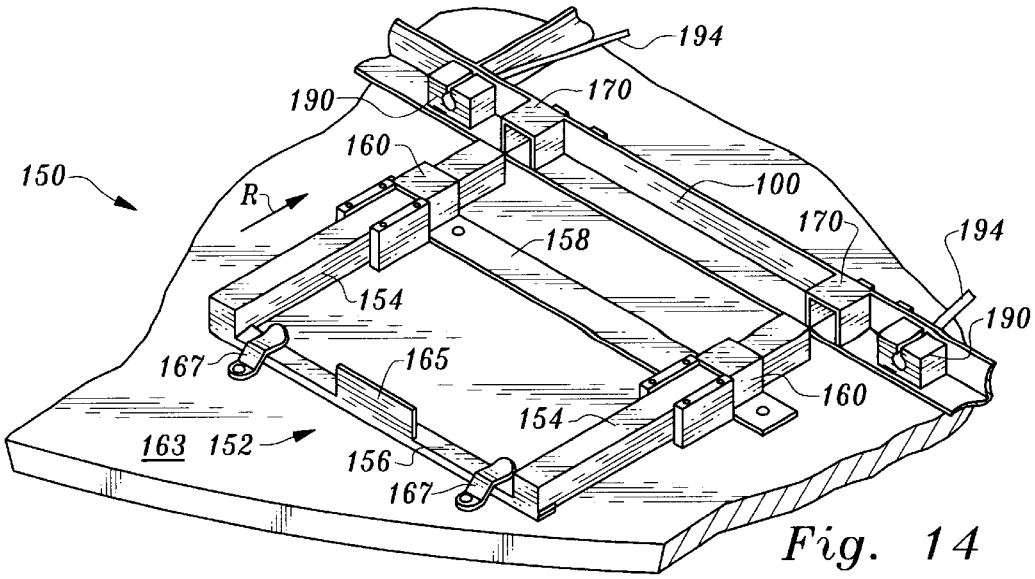
FIG. 14 is an enlarged and further fragmented view of the table undersurface as seen in FIG. 11, emphasizing the leaf positioning and locking mechanism, in its unlocked position, in some considerable detail.

Referring to FIG. 14, a U shaped locking slide 152 is provided and comprises a pair of opposed locking posts 154, fixed relative to one another by means of a cross bar 156. A strap 158, having guides 160, encircle the locking posts 154 to fix the position thereof relative to the bottom 163 of the leaf, while permitting reciprocating movement in the direction of the arrow R.

In order to facilitate digital movement of the locking slide 152 an extension 165 on the cross bar 156 is readily engaged by the user's hand to move the locking slide. Clamps 167 secure the locking slide against inadvertent movement when the leaf is collapsed.

Figure 15:
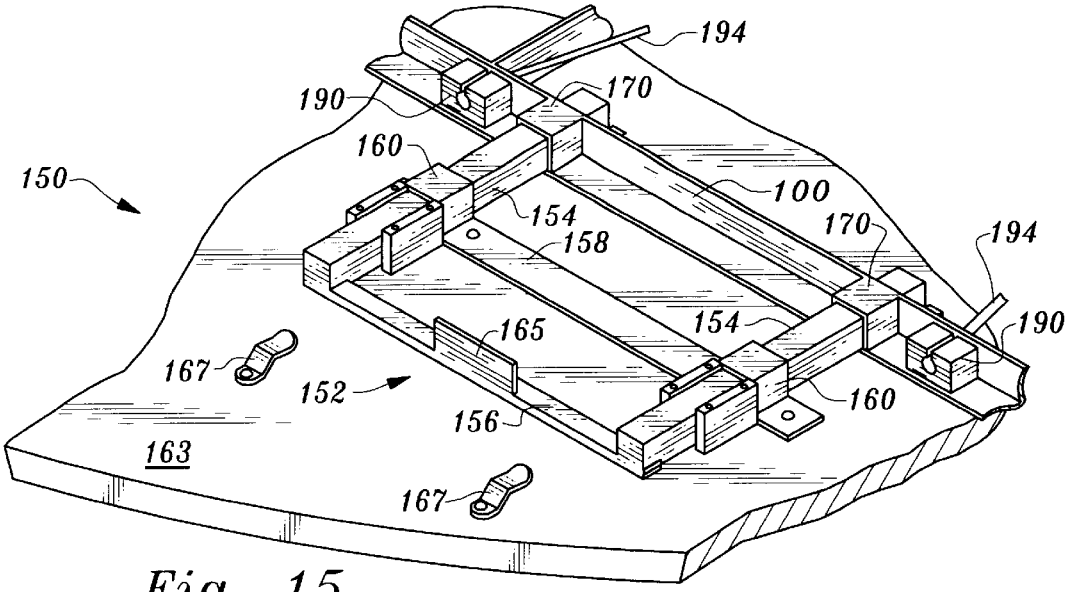
FIG. 15 is a view similar to FIG. 14, but with leaf locking mechanism in its leaf support and locked position.

In order to effect locking of a leaf in its extended position, the frame rails 100 are formed, or otherwise provided with receptacles 170. There is a receptacle 170 that is in axial alignment with each locking post 154, and movement of a locking slide inwardly towards the frame of the table will inevitably result in engagement of the locking posts in the axially aligned receptacle, with the consequent result that the leaf to which the locking slide is attached will be secured in its extended position, as seen more particularly in FIG. 15.

It is often impractical to have a series of individual tables variously configured in an event. Space constraints and other considerations tend to dictate the need to be able to tie a number of tables together in a desired configuration. Yet conventional thinking is to push a number of squares and/or rectangles together in a predetermined configuration and hope that they stay together. However, experience has taught the event manager, that unless the tables are identical and are of the same manufacture, minimal, but disquieting height variations may exist which disturb the atmosphere and participants. Moreover, one clumsy move by a participant could, and would, disturb several others because of the fact that tables loosely abut one another.

An important feature of the present invention is that contiguous tables may be tied together to provide an essentially structurally homogeneous pattern of tables that remains undisturbed by the comings and goings of those seated thereat.

By way of example, it will be appreciated that in theme display events, the event is significantly enhanced when the table arrangement has an overall appearance and layout that is artistic and conducive to the enjoyment of the participants. This is the natural and probable consequence of arranging the tables so as to reflect, or at least compliment, the particular theme involved. This table is singularly capable of accomplishing this objective when intermixed with other like or dissimilar configured tables. By way of example, if the event is a celebration of the Chinese New Year, tables of the present invention are readily sculpted into a variety of shapes including, but clearly not limited to, dragons and other animals.

Business or informational conference events require tables that create "focused" seating for small groups, i.e., the participants are seated in a direction which permits, indeed compels, them to focus on the speaker, or the stage, or the screen. These tables accomplish this objective by permitting the creation of shapes that inherently focus the participant on the point at which information is being imparted and utterly without distraction or sacrifice to the comfort of the participant.

Figure 24:
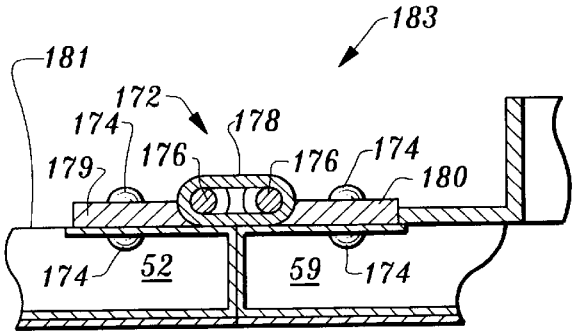
FIGS. 24 and 25 are views, enlarged and partially sectioned, to illustrate the interrelationship of the leaves of the table and the table proper in the leaf extended position (FIG. 24) and the leaf retracted position (FIG. 25)

In order to achieve the foregoing objective, it is initially important that the edges of abutting tables be flush, i.e., that the vertical surfaces of all edge portions of tables whether leaves extended or folded, present a coplanar, vertical surface, totally free of protuberances. To this end, and with particular reference to FIGS. 24 and 25, it will be seen that each leaf, whether it be 59, 60, 61 or 62, is hinged to the table top 52 by means of a hinge 172.

Figure 25:
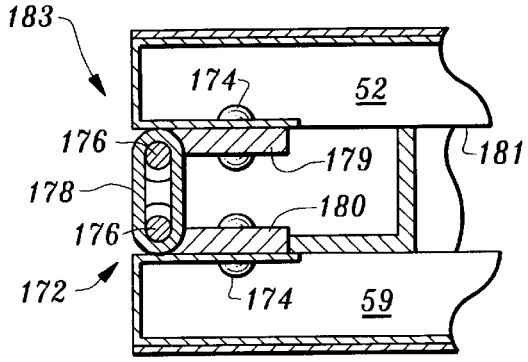

Each hinge is affixed to, respectively, a leaf, e.g., leaf 59, and to the table top 52, by an appropriate fastener, such as by way of example only, rivets 174. A hinge uniquely suited to the purpose is a double acting hinge in which a pair of hinge pins 176 are spaced apart, and operatively encased in an elliptical strap 178. As seen in FIG. 25, the table top is wrapped about one of said hinge pins by means of strap 179, and the table is operatively connected to the other pin by means of strap 180.

Such a hinge permits the leaf, in this instance 59, to fold flush against the under surface 181 of the table top 52, with the result that the vertical edge 183 defined by the edges of the table top and folded leaf, presents a flat surface to a contiguous table to which a connection is contemplated.

Figure 27:
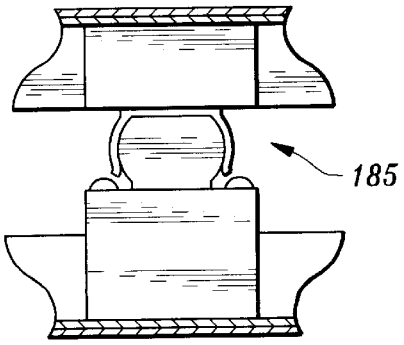
FIG. 27 illustrates a leaf lock mechanism for securing each leaf to the underside of the table.

As seen in FIG. 27, a clamp 185 secures the leaf in its folded condition and prevents inadvertent falling against a person seated at the table.

In order to fully realize the objectives of the present invention, it is important that the event tables be stable and secure, particularly when they have been arranged in a creative array and joined in a train of tables. Absent means for providing stabilization, the participants, who inevitably get up, move around, and bump others, in addition to the tables, will find any unusual arrangement confusing and uncomfortable.

Figure 26:
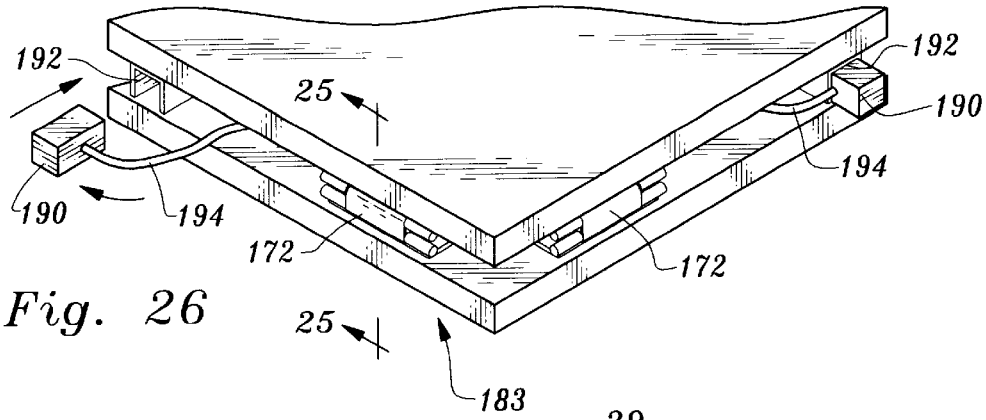
FIG. 26 is a partial sectional view of the table proper with the contiguous leaf retracted, and the perimeter locking mechanism in position to manually effect an inter table engagement.

In order to avoid such problems, and accomplish the defined purposes of the event table, means is provided for readily interconnecting any two contiguous edges of adjacent tables to provide both security and stability. To this end, and for this purpose, connector blocks 190, best seen in FIG. 26, are provided.

Each connector block 190 is of sturdy construction, preferably of any one of several light weight materials, and is formed to be of sufficient length as to be able to nest in, and between opposed, axially aligned, channels 192 of contiguous tables, each such channel 192 being formed integrally with the table's framework which forms the perimeter of the frame 65.

Each channel on every table is uniformly spaced along the respective frame rails of each frame. Thus, when edges of contiguous tables are brought together and aligned, the channels 192 of adjacent tables are similarly coaxially aligned. Thus, each connector block will engage an aligned pair of coaxial channels to lock tables in a chosen train of tables.

In order to provide optimum flexibility in the use of connector blocks 190, each block is preferably, but not necessarily, connected to a flexible lanyard 194, such as, e.g., a bungee cord. Clearly, a cord, or even a chain would be workable.

It is preferred that there be a minimum of one, and as many as two connector blocks on each of the four sides of the frame 65 and, in the interest of efficiency, a single lanyard 194 can attach to adjacent blocks on a single side, when two are employed, such as may be seen in FIG. 13, for example. The lanyard is anchored in any suitable fashion such as at 196, to the underside of the tabletop, although it may also mounted to the frame without departure from the invention, and the blocks for a particular table are easily nested in the channels for that table when not in use. By using a stretchable lanyard, the nesting of the blocks during storage is facilitated, while permitting them to be moved into a locking position during use.

It will be now be apparent that a person of average dexterity can readily interconnect tables in a fast and efficient manner with the system herein described to form a train of tables that may assume a wide variety of multi table configurations.

Figure 28:
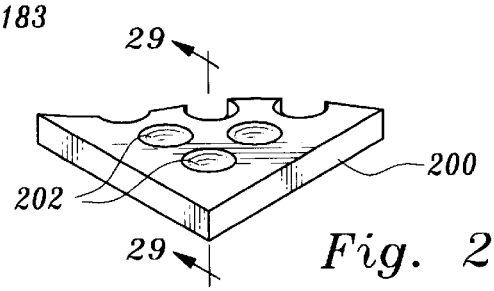
FIG. 28 is an enlarged fragment of the table top, illustrated pictorially to show a method of reducing table weight; and, FIG. 29 is a view of the table top of FIG. 28, as seen along section line 29—29.
Figure 29:
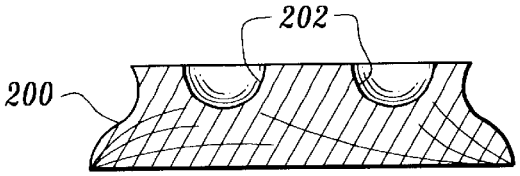

It is of importance to the success of the table of the present invention that, in addition to its unparalleled versatility, that it be easily handled whether during set up, configuration, breakdown or in storage. One of the ways that these objectives are accomplished is to make the table as light as possible. To this end, and with reference to FIGS. 28 and 29, the table top may include an insert, or laminate, 200 of a light wood or wood simulation material that is both attractive and utilitarian.

The insert 200 is, in accordance with this aspect of the invention, dimpled as at 202, by the removal of material therefrom, such as by routing, although other well known methods of removing material are contemplated without departure from the invention. In this manner, unneeded weight is excised without sacrifice to strength, making the table lighter and much more manageable in both set up and breakdown, and of course, storage.

Having thus described a preferred embodiment of the present invention, what is claimed is:

1. An event table comprising in combination:

a table top, said table top being polygonal in shape, and having a plurality of straight edges defining the perimeter thereof; contiguous ones of said straight edge being joined at an end thereof, said table top having a longitudinal axis, and a latitudinal axis, said longitudinal axis being transverse to said latitudinal axis;

a rigid frame; said table top being secured to said frame for selective support on a flat surface;

a plurality of pairs of leaves, said leaves being attached about the perimeter of said table top, each leaf having a straight edge and a curved edge generated about said straight edge, said curved edge extending outwardly from an end of said straight edge, and having a rounded apex at the midpoint thereof;

each leaf of a pair of said leaves being disposed in opposed relation on opposite sides of said table top;

said straight edge of each said leaf being hingeably attached to one of said straight edges of said table top; said curved edge having its apex along either said longitudinal axis or said latitudinal axis; a portion of the curved edge between the apex thereof and the straight edge becoming linear toward its juncture with an end of said straight edge, said leaves being individually and selectively movable between an extended position and a retracted position to define a desired table configuration.

2. The event table of claim 1 wherein said event table has a generally elliptical appearance when all of said leaves are in their extended position and viewed from above the top thereof.

3. The event table of claim 2, wherein the curvature of each said curved edge of said leaves being such that when all of said leaves are extended, the event table is symmetrical about a axis bisecting said table top.

4. The event table of claim 2, wherein said straight edge of each said leaf and said straight edge of said table to which said straight edge of said leaf is hingeably attached are disposed in a common vertical plane when said leaf is retracted.

5. The event table of claim 2, wherein the straight edge of each said leaf is attached to a straight edge of said table top by means of a hinge; said hinge comprising a pair of hinge pins, said hinge pins being encased in an elliptical strap, said hinge pins being operatively disposed in spaced relation; the edge of said table top being attached to one rotatably to one said hinge pin, said leaf being attached to the other of said hinge pins such that said leaf is foldable beneath said table top to its retracted position so that edge thereof is flush with the edge of said table top.

6. The event table of claim 5, wherein each said support includes at least one inner leg, said inner leg terminating in a transverse foot, said transverse foot being parallel to said table top.

7. The event table of claim 5, wherein locking means is provided for securing said inner leg relative to said support in a preselected position.

8. The event table of claim 2, wherein means is provided for securing said leaf in its extended position.

9. The event table of claim 2, wherein each of said leaves is selectively retracted or extended to provide a variety of table shapes.

10. The event table of claim 2, wherein each said support includes at least one inner leg, said inner leg terminating in a transverse foot, said transverse foot being parallel to said table top.

11. The event table of claim 2, wherein locking means is provided for securing said inner leg relative to said support in a preselected position.

12. The event table of claim 1, wherein the curvature of each said curved edge of said leaves being such that when all of said leaves are extended, the event table is symmetrical about a centerline bisecting said table top.

13. The event table of claim 1, wherein said straight edge of each said leaf and said straight edge of said table to which said straight edge of said leaf is hingeably attached are disposed in a common vertical plane when said leaf is retracted.

14. The event table of claim 1 wherein the straight edge of each said leaf is attached to a straight edge of said table top by means of a hinge; said hinge comprising a pair of hinge pins, said hinge pins being encased in an elliptical strap, said hinge pins being operatively disposed in spaced relation; the edge of said table top being attached to one rotatably attached to one said hinge pin, said leaf being attached to the other of said hinge pins such that said leaf is foldable beneath said table top to its retracted position so that edge thereof is flush with the edge of said table top.

15. The event table of claim 1, wherein means is provided for securing said leaf in its extended position.

16. The event table of claim 1, wherein the leaf is secured in its retracted position.

17. The event table of claim 1, wherein each of said leaves is selectively retracted or extended to provide a variety of table shapes.

18. The event table of claim 1, having supports, said supports being slidably secured to said frame, and slidable away from each other to move into a support position for holding said tabletop above a surface upon which it rests, and movable toward one another to nest in said frame.

19. The event table of claim 1, having supports, said supports being slideably secured to said frame, and slidable toward each other to move into a support position for holding said table top above a surface upon which it rests, and movable away from one another to nest in said frame.

20. The event table of claim 19, wherein said inner leg is telescoped within said support for coplanar movement relative thereto.

21. The event table of claim 1, wherein each said support includes at least one inner leg, said inner leg terminating in a transverse foot, said transverse foot being parallel to said table top.

22. The event table of claim 21, wherein said inner leg is incrementally extensible between a higher position and a lower position to vary the height of said table top.

23. The event table of claim 21, wherein locking means is provided for securing said inner leg relative to said support in a preselected position.

24. The event table of claim 1, wherein said table top is formed with a series of indentations therein, said indentations resulting from removal of material to lighten said table.

25. The event table of claim 24, wherein said indentations are formed on the underside of said table top.

26. A train of event tables wherein each said event table comprises:

a table top, said table top being rectangular in shape, and having four straight edges defining the perimeter thereof;

a rigid frame; said table top being secured to said frame;

a plurality of leaves, each leaf having a straight edge, and a curved edge generated about said straight edge;

said straight edge of each said leaf being hingeably attached on one of said straight edges of said table top; the curvature of each said curved edge being such that when all of said leaves are extended, the event table is symmetrical about a centerline bisecting said table top;

supports, said supports being slideably secured to said frame, and slidable away from each other to move into a support position for holding said tabletop above a surface upon which it rests, and movable toward one another to nest in said frame;

locking means for selectively interconnecting contiguous ones of said tables in a predetermined sequence to effect a train of uniquely connected event tables.

27. The event table of claim 26, wherein said locking means includes blocks, said blocks being attached to said tabletop;

channels disposed in said frame, said channels being transverse to the edge of said table top, said channels being sized to receive, in nesting relation, said blocks;

said channels being axially aligned when contiguous tables are placed edge to edge, and said blocks engageable with contiguous channels of said tables to interlock said tables in said train.

28. The event table of claim 26, wherein said blocks are attached to said table by a flexible line.

29. An event table comprising in combination:

a table top, said table top being polygonal in shape, and having a plurality of straight edges defining the perimeter thereof; contiguous ones of said straight edge being joined at an end thereof, said table top having a longitudinal axis and a latitudinal axis, said longitudinal axis being transverse to said latitudinal axis;

a rigid frame; said table top being secured to said frame for selective support on a flat surface;

a plurality of pairs of leaves, said leaves being attached about the perimeter of said table top, each leaf having a straight edge and a curved edge generated about said straight edge, said curved edge extending outwardly from an end of said straight edge and having a rounded apex at the midpoint thereof;

each leaf of a pair of said leaves being disposed in opposed relation on opposite sides of said table top;

said straight edge of each said leaf being hingeably attached to one of said straight edges of said table top;

said curved edge having its apex along either said longitudinal axis, or said latitudinal axis;

a portion of the curved edge between the apex thereof, and the straight edge becoming linear toward its juncture with an end of said straight edge, said linear portions of adjacent leaves defining a plane;

said leaves being individually and selectively movable between an extended position and a retracted position to define a desired table configuration.

* * * * *